US007478566B2

(12) United States Patent
Liao

(10) Patent No.: US 7,478,566 B2
(45) Date of Patent: Jan. 20, 2009

(54) ELECTRICAL TORQUE-INDICATING WRENCH

(75) Inventor: Wen-Hwei Liao, Cihtong Township, Yunlin County (TW)

(73) Assignee: National Formosa University (TW)

( * ) Notice: Subject to any disclaimer, the term of this patent is extended or adjusted under 35 U.S.C. 154(b) by 77 days.

(21) Appl. No.: 11/633,014

(22) Filed: Dec. 4, 2006

(65) Prior Publication Data

US 2008/0127748 A1 Jun. 5, 2008

(51) Int. Cl.
*B25B 23/14* (2006.01)

(52) U.S. Cl. ..... 73/862.21; 73/862.22; 73/862.23

(58) Field of Classification Search .. 73/862.21–862.23
See application file for complete search history.

(56) References Cited

U.S. PATENT DOCUMENTS 4,982,612 A * 1/1991 Rittmann ..... 73/862.23
6,928,885 B1 * 8/2005 Shiao et al. ..... 73/862.21
6,948,380 B1 * 9/2005 Shiao et al. ..... 73/862.21
7,287,439 B2 * 10/2007 Chen et al. ..... 73/862.21
7,313,990 B1 * 1/2008 Shiao et al. ..... 81/479

* cited by examiner

*Primary Examiner*—Harshad Patel
*Assistant Examiner*—Freddie Kirkland, III
(74) *Attorney, Agent, or Firm*—Dykema Gossett PLLC

(57) ABSTRACT

An electrical torque-indicating wrench of the present invention, capable of providing accurate measurements, comprising: a wrench body having a head to engage and turn a workpiece, and a stem having two supporting portions protruding from its side surface or the cavity surface of the stem; a handle coupled with the stem and operable to turn the head about the rotational axis; strain bodies including strain gages, said strain bodies disposed on said support means are adapted to provide measured values of the torque; and a torque indicating device which is connected to said strain bodies transfers the measured values into a visual presentation for viewing.

5 Claims, 8 Drawing Sheets

ELECTRICAL TORQUE-INDICATING WRENCH

BACKGROUND OF THE INVENTION

1. Field of the Invention

The invention relates to a wrench, more particularly to a torque-indicating wrench with excellent precision.

2. Description of the Related Art

U.S. Pat. Nos. 6,928,885 and 6,948,380 disclose electrical torque-indicating wrenches that generally have strain gages attached to a handle for measuring the torque. The location of the strain body in the handle is normally close to a head's position, wherein the head is used to engage and rotate a workpiece by applying a force to the handle. The strain gages detect the elastic strains and the changes in electrical resistances, and translate the changes into an electrical signal, in cooperation with a processing circuit, the strain gages can determine a value of torque applied to the workpiece.

Refer to FIGS. 1 and 2, 3-D assembly views of a conventional electrical torque-indicating wrench, which comprises a head 211, at least one strain body 218, a strain gage unit 212 located on each strain body 218, a processing circuit 213, a display unit 214, and a stem 215. The strain gage unit 212 includes several strain gages 219. The stem 215 includes an outer longitudinal surface 216 (in FIG. 1) or a recess slot 217 (as shown in FIG. 2). The strain gage unit 212 can be replaced when one of the strain gages 219 is broken, and strain body 218 is attached to the outer longitudinal surface 216 or a surface of the recess slot 217 of the stem 215. When a torque is applied to the head 211, a torque is produced to induce stretching deformation (applying the tensile force) on the strain gages 219 resulting in a change of the electrical resistance, which can be detected and translated into an electrical signal. After processing the electrical signal in the processing circuit 213, the processed electrical signal will then be transferred into readable data showed on the display unit 214.

Since the conventional torque-indicating wrenches is designed with the strain body 218 in contact with the outer longitudinal surface 216 or the recess slot 217 of the stem 215, during the stretching deformation, the strain body 218 would slide against to the surface of the stem 215, as a result, the contact portion between the strain body 218 and the surface of the stem 215 is unstable. In addition, according to FIG. 1, the strain body 218 is designed with a flat-shaped structure, the strain body 218 would be seriously sliding against the stem 215 while stretching the strain body 218. As a matter of fact, the combination of the strain body 218 and the stem 215 would cause the torque-indicating wrenches becoming very unstable to perform the task, such as, inaccurate measurements would be obtained, and the errors would occur in the electrical signal resulting the correct torque value could not be obtained.

SUMMARY OF THE INVENTION

An object of the present invention is to provide a torque-indicating wrench which has at least one strain body including strain gages firmly mounted to a wrench body for measuring a torque applied to a workpiece with a high degree of precision.

The torque-indicating wrench of the present invention comprises a wrench body having a head which is adapted to engage and turn a workpiece about a rotational axis, and a stem which extends from the head in a longitudinal direction radial to the rotational axis, wherein the stem has at least one support mean protruding from a surface of the wrench body; a handle is coupled with the stem, and capable of rotating the head about the rotational axis; strain bodies comprise strain gages, wherein the strain bodies disposed on the support means are adapted to provide measured values of the torque; and a torque indicating device which is connected to said strain bodies transfers the measured values into a visual presentation for viewing.

Both the forgoing general description and the following detailed description are exemplary and explanatory only and are not restrictive of the invention, as claimed.

BRIEF DESCRIPTION OF THE DRAWINGS

The accompanying drawings are included to provide a further understanding of the present invention, and are incorporated in and constitute a part of this specification. The drawings illustrate embodiments of the present invention and, together with the description, serve to explain the principles of the invention. In the drawings.

DETAILED DESCRIPTION OF THE PREFERRED EMBODIMENTS

Figure 1:
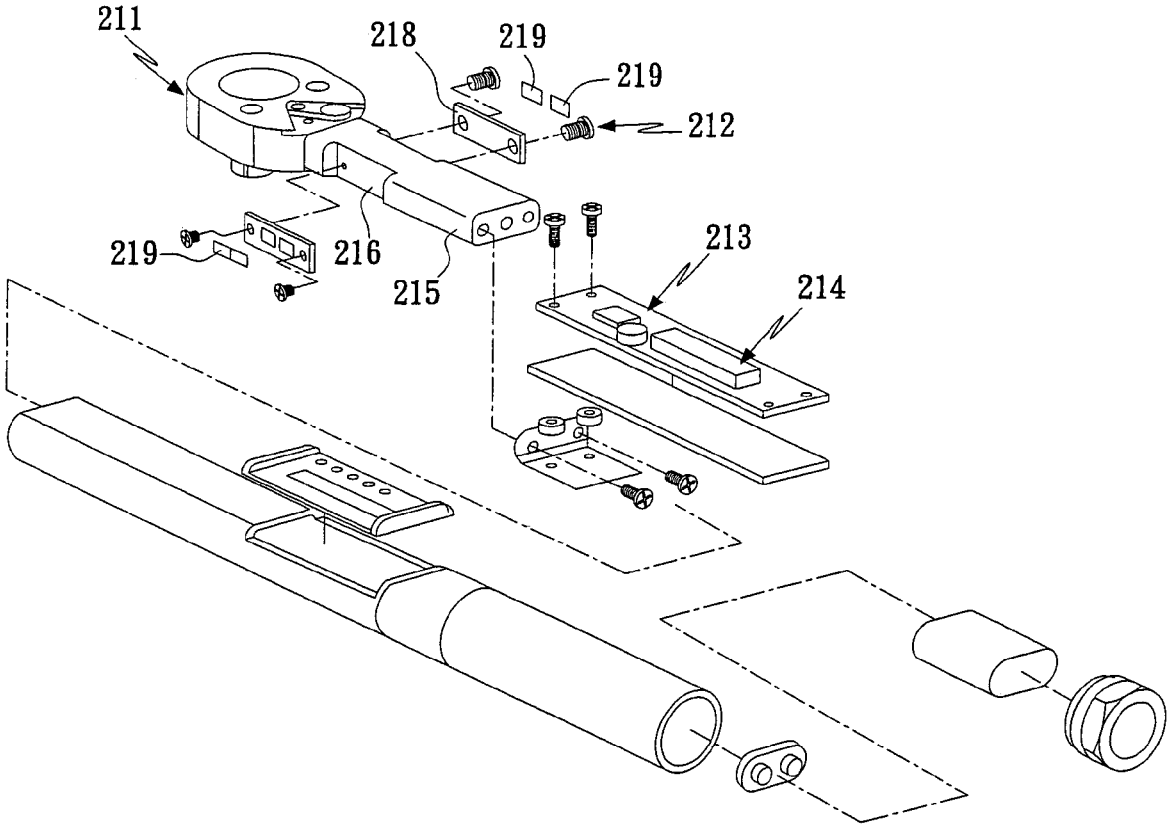
(PRIOR ART) Fig. 1
FIG. 1 is an exploded perspective view of a conventional torque-indicating wrench.
Figure 2:
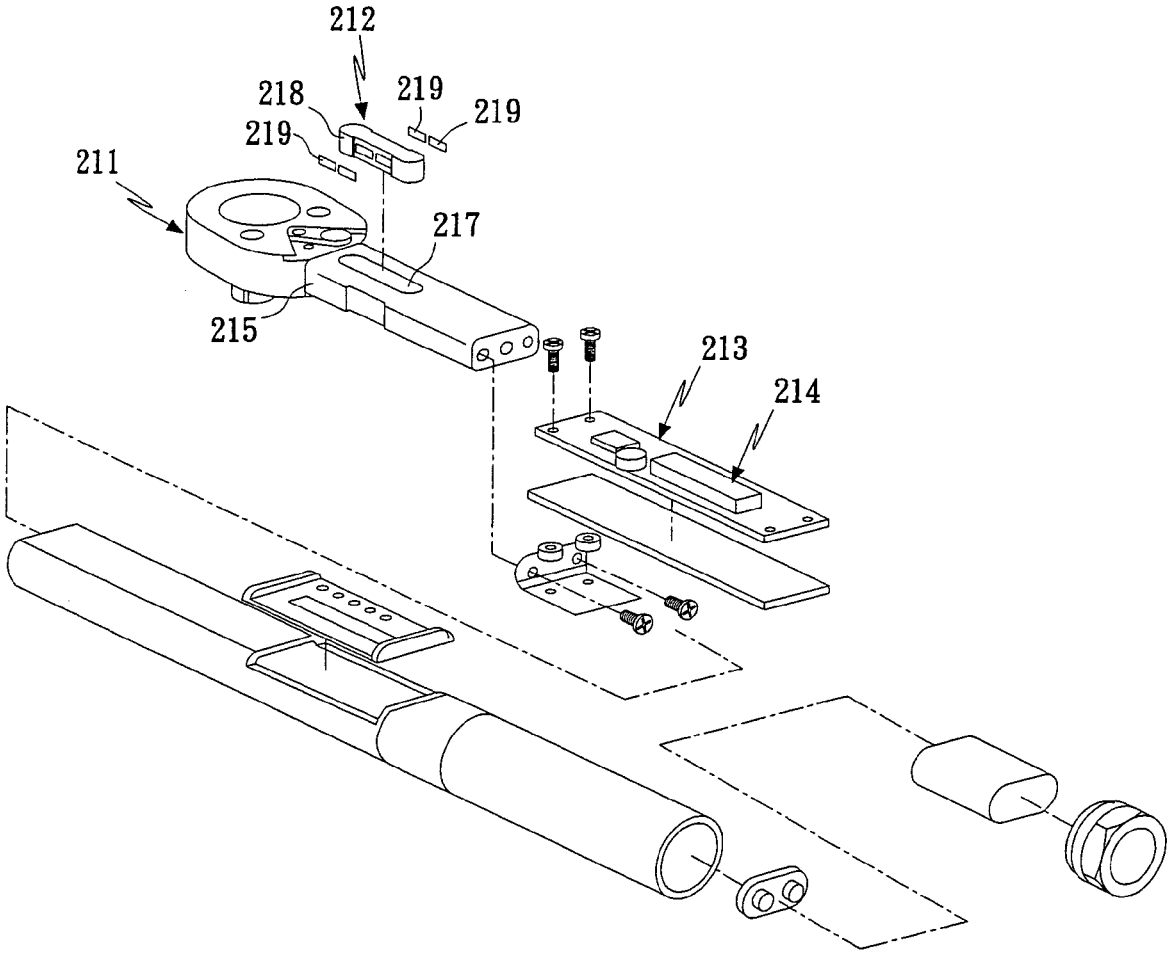
(PRIOR ART) Fig. 2
FIG. 2 is another exploded perspective view of another conventional torque-indicating wrench.

Before the present invention is described in greater detail, it should be noted that same reference numerals have been used to denote like elements throughout the specification.

Figure 3:
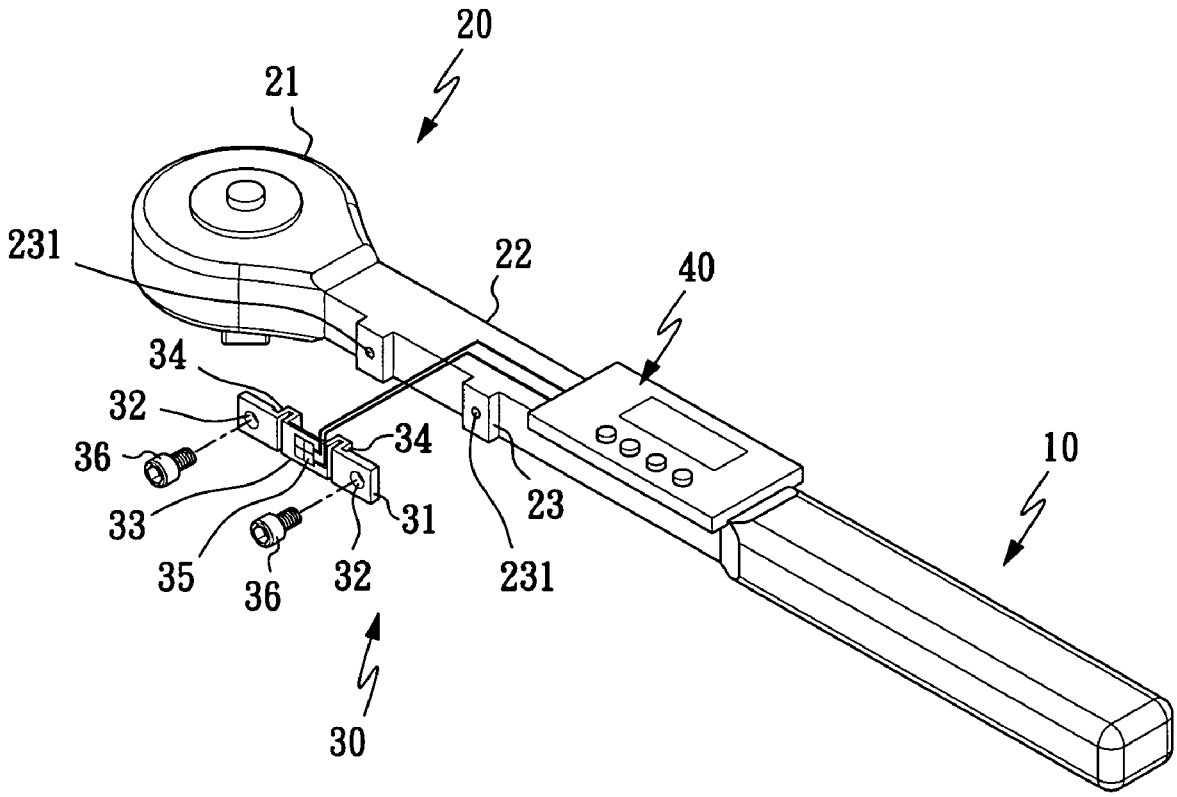
FIG. 3 is a 3-D view of an electrical torque-indicating wrench in accordance with a first preferred example of the present invention.
Figure 4:
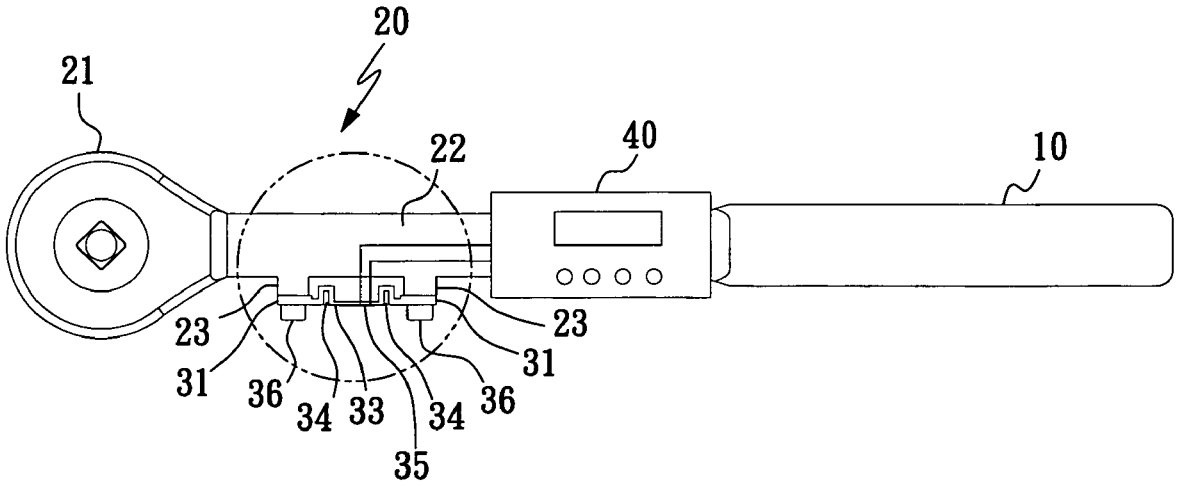
FIG. 4 is a schematic view of the electrical torque-indicating wrench in accordance with the preferred example of the present invention.
Figure 5:
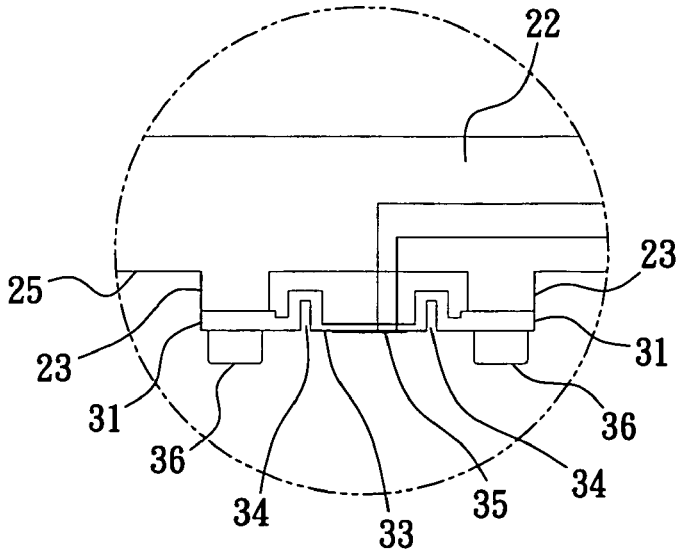
FIG. 5 is a partial enlarged view illustrating the stem portion of the electrical torque-indicating wrench in FIG. 4.

Refer to FIGS. 3-5, a torque-indicating wrench according to a first preferred example of the present invention comprises a handle 10, a wrench body 20, a strain body 30, and a torque indicating device 40. The wrench body 20 has a head 21 which is adapted to engage and turn a workpiece (not shown) about a rotational axis. A stem 22 which extends from the head 21 in a longitudinal direction radial to the rotational axis, and there are two supporting portions 23 which are spaced apart from a predetermined distance protruding from the surface of the stem 22; a handle 10 is connected to the stem 22 and a strain body 30 including two end portions 31 is provided at the stem 22, wherein a middle portion 33 is connected to the end potions 31, and parts connected between the end portions 31 and the middle portion 33 are flex portions 34. The end portions 31 of the strain body 30 are disposed to the supporting portions 23 by means of fixing two screws 36 through holes 32 and screw holes 231; and a torque indicating device 40 which electronically connected to the strain gages 35 is disposed at the wrench body 20.

With further reference to FIG. 5, a partial enlarged view illustrating the stem 22 portion of the electrical torque-indicating wrench in FIG. 4 is shown. When a torque is applied to the head 21 to turn a workpiece about the rotational axis, the torque producing force is transmitted to the strain body 30 so as to result in stretching deformation of the strain body 30. Since the strain body 30 is designed to have the supporting portions 23 protruding from the surface of the wrench body 20, the deformational displacement of the strain body 30 is not interfered by the surface of the stem 22. In addition, characteristics of the present invention are as follows: the supporting portion 23 of the present invention is designed to protrude from the surface of the stem 22 in such that it can absorb the impact of the torque and prevent the sliding movement from occurring on the connecting portion of the stem 22 and the strain body 30, and the structure of the flex portions 34 is designed in such a way that it can also absorb enormous impact force in order to provide the precise measurements of the strain gage 35.

The strain gage 35 is attached to the middle portion 33 of the strain body 30 for detecting any change in resistant values, any alternation in the electrical resistance indicates any change in the stretching deformation of the strain body 30. In other words, any change in the stretching deformation of the strain body 30 can be indicated and shown through the readings of the electrical resistance resulting from the torque applied to the head 21; since the stretching deformation of the strain body 30 is caused by torque applied to the electrical torque-indicating wrench, as a result, the strain body 30 gets measured values of torque applied to the electrical torque-indicating wrench.

The torque indicating device 40 which is connected electrically to the strain gage 35 is mounted onto the stem 22. The torque indicating device 40 calculates a value of the torque applied to the workpiece in accordance with the electrical signal obtained from the strain gage 35, and then transfers the electrical signal into a visual presentation for viewing.

Figure 6:
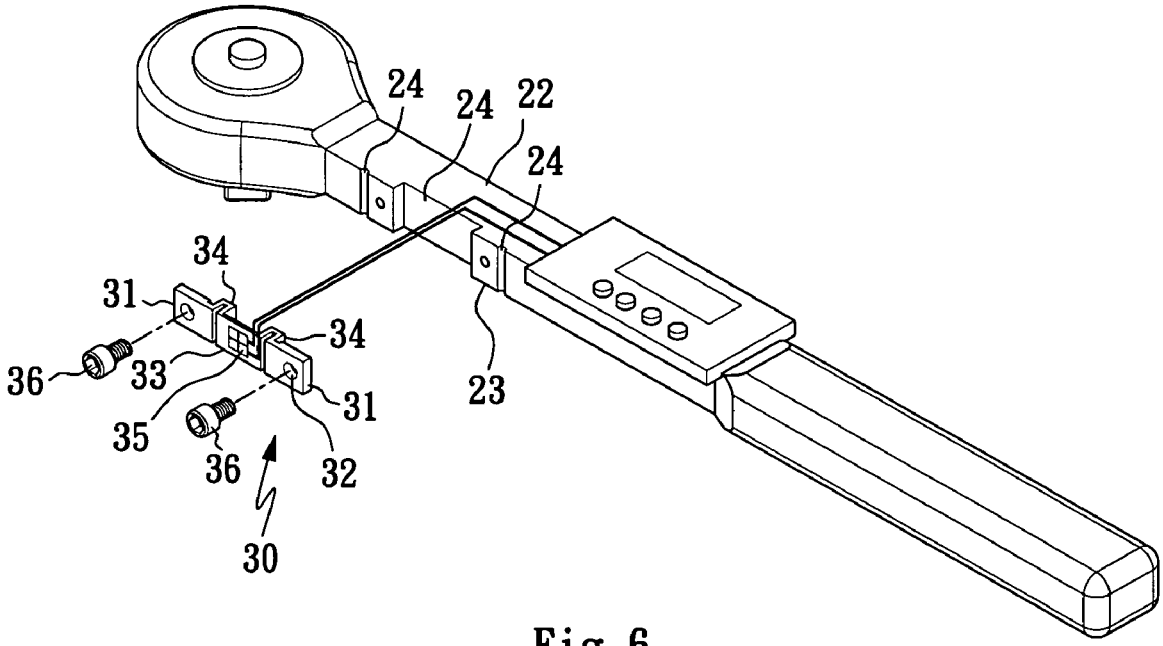
FIG. 6 is a 3-D view of an electrical torque-indicating wrench in accordance with a second preferred example of the present invention.

As shown in FIG. 6, a second preferred embodiment of an electrical torque-indicating wrench according to this invention is shown to be similar to that of the first preferred embodiment in construction, function and effect. It shows another machine processing to make the supporting portion 23 protruding from the surface of the stem 22 by producing three recesses 24 in the stem 22.

Figure 7:
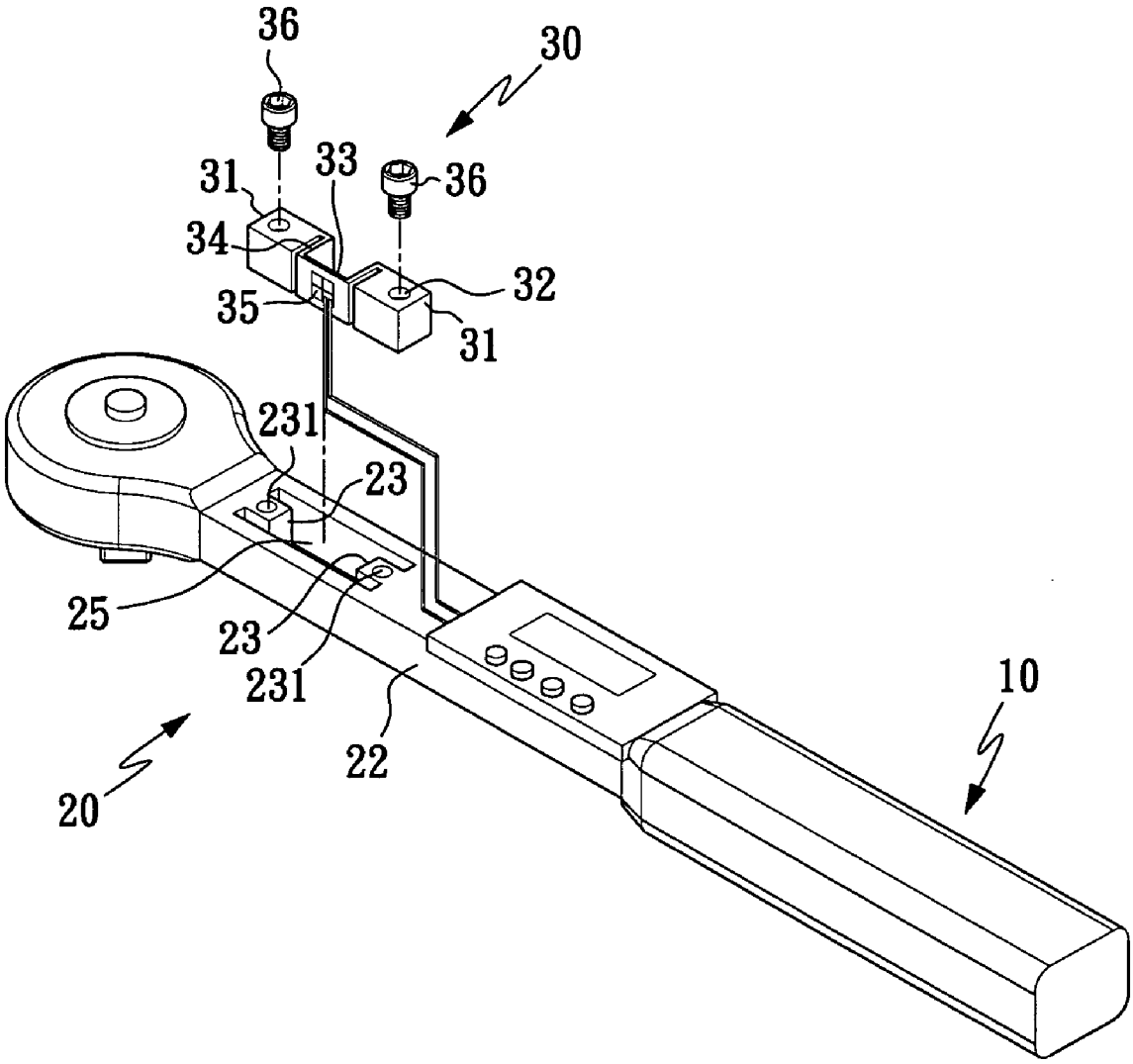
FIG. 7 is a 3-D assembly view of an electrical torque-indicating wrench in accordance with a third preferred example of the present invention.

As shown in FIG. 7, a third preferred embodiment of a torque-indicating wrench according to this invention is shown to be similar to that of the first preferred embodiment in construction, function and effect. Instead of protruding the supporting portions 23 from the surface of the stem 22, the supporting portions 23 of the third preferred embodiment is designed to protrude from a surface of a cavity 25 of the stem 22, and the middle portion 33 of the strain body 30 is designed to detect the rotation of the head 21.

Figure 8:
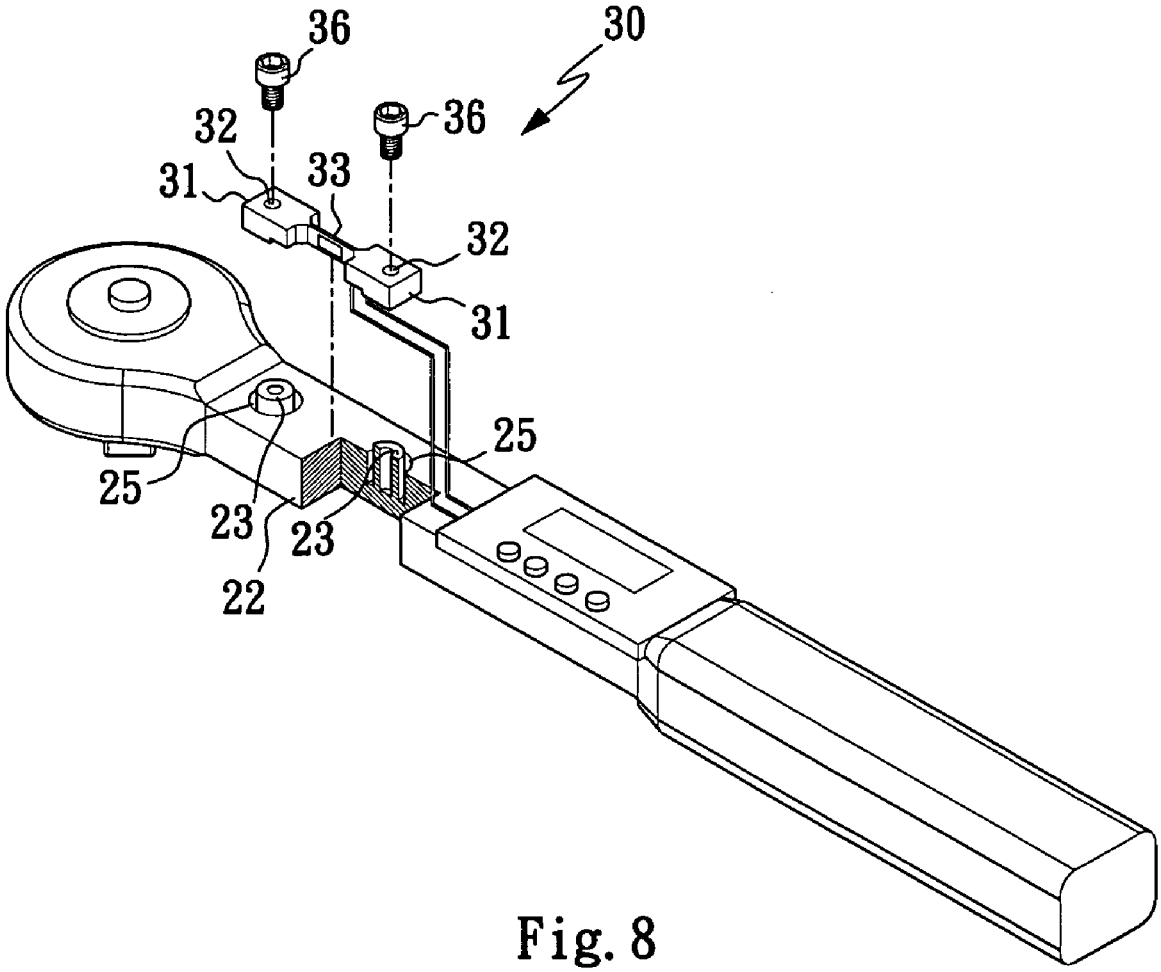
FIG. 8 is a 3-D assembly view of an electrical torque-indicating wrench in accordance with a fourth preferred example of the present invention.

As shown in FIG. 8, a fourth preferred embodiment of a torque-indicating wrench according to this invention is shown to be similar to that of the third preferred embodiment in construction, function and effect. Instead of one cavity on the stem, there are two cavities 25 and each has a supporting portion 23 protruding from the bottom surface of the cavity.

Figure 9:
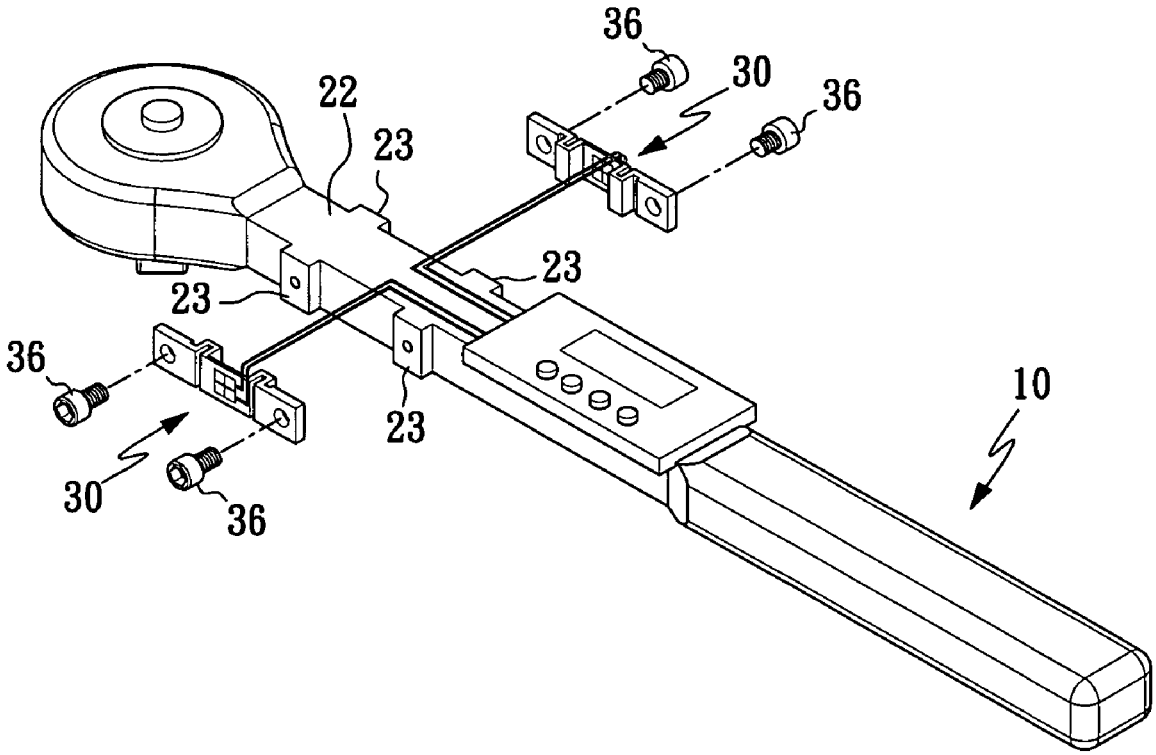
FIG. 9 is a 3-D assembly view of an electrical torque-indicating wrench in accordance with a fifth preferred example of the present invention.

As shown in FIG. 9, a fifth preferred embodiment of a torque-indicating wrench according to this invention is shown to be similar to that of the first preferred embodiment in construction, function and effect. Multiple strain bodies disposed to the stem 22 are also in the scope of this invention.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

What is claimed is:

1. An electrical torque-indicating wrench, comprising:

a wrench body having a head which is adapted to engage a workpiece, and a stem which is extended from the head, wherein the stem has at least one supporting portion protruding from a surface area of the wrench body;

a handle coupled with the stem, wherein the handle is utilized to turn the head about a rotational axis;

at least one strain body, each strain body having at least one strain gage is disposed on the supporting portion for getting measured values of torque applied to the electrical torque-indicating wrench, the strain body is a flat plate with two end portions and one middle portion, one hole is provided on the each end portion, the strain body further comprises at least one flex portion which is a connection of the middle portion and one of the end portions; and a torque indicating device connecting to the strain gage, wherein the torque indicating device transfers the measured values into a visual presentation for viewing.

2. The electrical torque-indicating wrench of claim 1, wherein the torque indicating device further includes a processing circuit and a display unit, wherein the processing circuit is connected electrically to the strain gage to calculate the measured value of the torque applied in accordance with electrical signal received from the strain gages in order to generate an output signal, the display unit is connected electrically to the processing circuit for receiving the output signal from the processing circuit, and it transfers the output signal into the visual presentation.

3. An electrical torque-indicating wrench, comprising:

a wrench body having a head which is adapted to engage a workpiece, and a stem which is extended from the head, wherein the stem has at least one cavity and at least one supporting portion protruding from a surface area of the cavity;

a handle coupled with the stem, wherein the handle is utilized to turn the head about a rotational axis;

at least one strain body, each strain body having at least one strain gage is disposed on the supporting portion for getting measured values of torque applied to the electrical torque-indicating wrench, the strain body is a flat plate with two end portions and one middle portion, one hole is provided on the each end portion, the strain body further comprises at least one flex portion which is a connection of the middle portion and one of the end portions; and a torque indicating device connecting to the strain gage, wherein the torque indicating device transfers the measured values into a visual presentation for viewing.

4. The torque-indicating wrench of claim 3, wherein the wrench body has one cavity and two supporting portions that are provided opposite to each other and are protruded from the surface area of the cavity.

5. The torque-indicating wrench of claim 3, wherein the wrench body has two cavities and one supporting portion protruding from a bottom surface of each cavity.

* * * * *